US006454106B1

(12) United States Patent
Howard

(10) Patent No.: US 6,454,106 B1
(45) Date of Patent: Sep. 24, 2002

(54) HOLDER FOR SHEET-FORM ARTICLES

(75) Inventor: Andrew Howard, Cheshunt (GB)

(73) Assignee: Benchmark Fabrications Limited, Hertfordshire (GB)

( * ) Notice: Subject to any disclaimer, the term of this patent is extended or adjusted under 35 U.S.C. 154(b) by 0 days.

(21) Appl. No.: 09/546,870

(22) Filed: Apr. 10, 2000

(30) Foreign Application Priority Data

Apr. 20, 1999 (GB) ..... 9908892

(51) Int. Cl.[7] ..... B42F 1/00
(52) U.S. Cl. ..... 211/50; 248/448; 211/43
(58) Field of Search ..... 211/50, 49.1, 42–43, 211/45, 55, 85, 104–105, 202, 126.6, 130.1, 132.1, 133.1, 195, 200, 175, 79; 248/448, 460, 149–150, 172, 166; 40/739, 741, 120

(56) References Cited

U.S. PATENT DOCUMENTS

| | | | | | |
|---|---|---|---|---|---|
| 593,120 | A | * | 11/1897 | Putnam | 248/448 |
| 829,897 | A | * | 8/1906 | Schilling | 211/50 |
| 1,071,428 | A | * | 8/1913 | Jones | 248/448 |
| 1,704,011 | A | * | 3/1929 | Mark | 211/43 |
| 1,750,576 | A | * | 3/1930 | Cubberley | 211/43 |
| 1,846,988 | A | * | 2/1932 | Buck | 211/50 |
| 2,040,315 | A | * | 5/1936 | Kress | 211/50 |
| 2,164,299 | A | * | 6/1939 | Mandell et al. | 248/448 |
| 3,691,664 | A | | 9/1972 | Stoian | 40/124.4 |
| 3,850,303 | A | | 11/1974 | Franklin | 211/134 |
| 4,037,756 | A | | 7/1977 | Jaquish | 221/242 |
| 4,116,413 | A | * | 9/1978 | Andersen | 248/451 |
| 4,165,572 | A | | 8/1979 | Sussman | 40/10 D |
| 4,328,631 | A | | 5/1982 | Foerster | 40/373 |
| 4,492,307 | A | | 1/1985 | Hargrave | 206/449 |
| 4,508,307 | A | * | 4/1985 | Morales | 248/460 |
| 4,666,039 | A | | 5/1987 | Corallo et al. | 206/424 |
| 4,771,977 | A | * | 9/1988 | Larson | 248/460 |
| 4,938,365 | A | * | 7/1990 | Conway et al. | 211/50 |
| 5,106,047 | A | | 4/1992 | Baer | 248/459 |
| 5,295,596 | A | * | 3/1994 | Squitieri | 211/175 |
| 5,372,348 | A | * | 12/1994 | Cheng | 248/460 |
| 5,421,466 | A | * | 6/1995 | Hsu | 211/120 |
| 5,456,033 | A | | 10/1995 | Sachnoff | 40/661 |
| 5,580,024 | A | * | 12/1996 | Briee | 248/451 |

FOREIGN PATENT DOCUMENTS

| | | | | |
|---|---|---|---|---|
| DE | 471335 | * | 2/1929 | 211/43 |
| DE | 43 12 360 A1 | | 10/1994 | |
| EP | 0 129 230 A2 | | 12/1984 | |
| EP | 0 421 795 A1 | | 4/1991 | |
| FR | 2 650 944 A1 | | 2/1991 | |
| FR | 2 661 083 | | 10/1991 | |
| FR | 2 725 937 A1 | | 4/1996 | |
| FR | 2 731 889 A1 | | 9/1996 | |
| GB | 0 607 413 | | 8/1948 | |
| GB | 0 870 941 | | 6/1961 | |
| GB | 2 061 093 A | | 5/1981 | |
| GB | 2 126 886 A | | 4/1984 | |
| GB | 2 176 694 A | | 1/1987 | |
| GB | 2 213 101 A | | 8/1989 | |
| GB | 2 234 428 A | | 2/1991 | |
| GB | 2 247 978 A | | 3/1992 | |
| WO | WO 91/18748 | | 12/1991 | |

* cited by examiner

*Primary Examiner*—Daniel P. Stodola
*Assistant Examiner*—Jennifer E. Novosad
(74) *Attorney, Agent, or Firm*—Woodcock Washburn LLP

(57) ABSTRACT

A holder for sheet-form articles designed as a display stand for leaflets, brochures and the like comprises a rear support member with two side support members movable jointly relative to the rear support member between extended and retracted positions, thereby to vary the width of the receiving space for the articles. Preferably, each rear plate of the side support members is provided with a generally diagonal slot therethrough, and studs projecting from the rear support plate are located within the slots to provide for guided sliding movement of the parts.

7 Claims, 3 Drawing Sheets

HOLDER FOR SHEET-FORM ARTICLES

FIELD OF THE INVENTION

This invention relates to holders for sheet-form articles, and is particularly concerned with display stands utilizable for articles such as leaflets, documents, cards, pamphlets, brochures, magazines and the like. The articles to be displayed in the holder can be single sheet articles or multiple sheet articles.

DESCRIPTION OF THE PRIOR ART

Many forms of display stands and racks are known for the display of sheet-form articles.

FR-A-2725937 shows a rack in which documents are separated by dividing walls whose position can be adjusted. The walls can slide along a guide and be fixed in place by stops. The dividing walls can be removed to increase available space and can be positioned in predetermined locations along the length of the rack.

US-A-3691664 shows an adjustable card holder with adjusting means for handling different lengths of cards. Reciprocating movement of a cover over a compartmented box adjusts the length of the compartments to accommodate cards of different length.

US-A-3850303 shows an adjustable storage rack for books and cassettes which has an inclined shelf and is adjustable in width. This is achieved by the use of telescopic sections movable horizontally.

GB-A-2126886 shows a portable workstand with members linked together by scissor linkages, so that the stand can be movable between a storage disposition in which the members are closed together and a work disposition in which the members open out to provide an inclined plane of support for a workpiece.

GB-A-0607413 shows a holder for photographs and like articles in which four metal strips are pin-jointed together at their ends to form consecutive links, the outer ends of the outer links being bent to form feet. Pivoting of the links provides for width adjustment of the holder.

GB-A-0870941 shows an apparatus for carrying flat plates or boards, especially for use by artists, in which a complex frame of pivotally linked members can be adjusted to permit paintings for example of different sizes to be carried in mutually spaced relationship so that they are protected.

SUMMARY OF THE INVENTION

It is the primary object of the present invention to provide a holder for sheet-form articles which is adjustable in a sense to enable articles of different sizes to be received in the holder in a well-supported manner. By providing an adjustable holder one can display sheet-form articles of different dimensions without on the one hand having to use a range of different size holders and without on the other hand having articles of relatively small dimensions loosely supported, if at all, within a holder which is too large.

The holder of the present invention enables a stack of sheet-form articles to be held supported at the rear and at the sides by simple adjustment of the holder.

In accordance with the present invention there is provided a holder for sheet-form articles which comprises a stand having:

(i) a rear support member against which the articles are arranged to rest, and (ii) a pair of side support members for edgewise support of the articles and defining a receiving space for the articles therebetween, wherein the side support members are jointly movable relative to the rear support member between extended and retracted positions thereby to vary the width of the receiving space.

The extension and retraction of the side support members enables the holder to be adjusted to receive articles between a predetermined maximum width dimension and a predetermined minimum width dimension or of any dimension in between.

Preferably, the side support members are movable relative to the rear support member in directions extending generally diagonally relative to a longitudinal axis of the rear support member. This means that on extension of the holder the side support members move downwards and outwards relative to the rear support member, whereas upon retraction of the side support members they move upwards and inwards relative to the rear support member.

This extension and retraction movement can be achieved for example by providing the side support members each with a generally diagonal slot therethrough and by providing the rear support member with projecting studs which engage in the respective slots and which thus permit sliding movement of the side support members relative to the rear support member.

In a preferred embodiment of the invention, each of the side support members is shaped to define a generally U-shaped support to encompass the marginal portion of the stack of articles to be held therein. The rearward limb of the U can be provided with the aforesaid diagonally extending slot and be slidable over the face of the rear support member on the studs projecting therefrom.

Also in accordance with the invention there is provided holder for sheet-form articles which comprises a stand having:

i) a rear support member having a front face against which the articles are arranged to rest, and ii) first and second side support members for supporting respective sides of the articles and together defining a space therebetween in which the articles can be positioned, wherein the side support members are jointly movable by a sliding motion relative to the rear support member thereby to vary the width of said receiving space.

Desirably, sliding movement of the side support members away from each other to increase the width of the receiving space simultaneously increases the height of the rear support member relative to the side support members to increase the area of support provided by the front face of the rear support member.

BRIEF DESCRIPTION OF THE DRAWINGS

In order that the invention may be more fully understood, one presently preferred embodiment of holder in accordance with the invention will now be described by way of example and with reference to the accompanying drawings, in which.

DESCRIPTION OF THE PREFERRED EMBODIMENT

Figure 1:
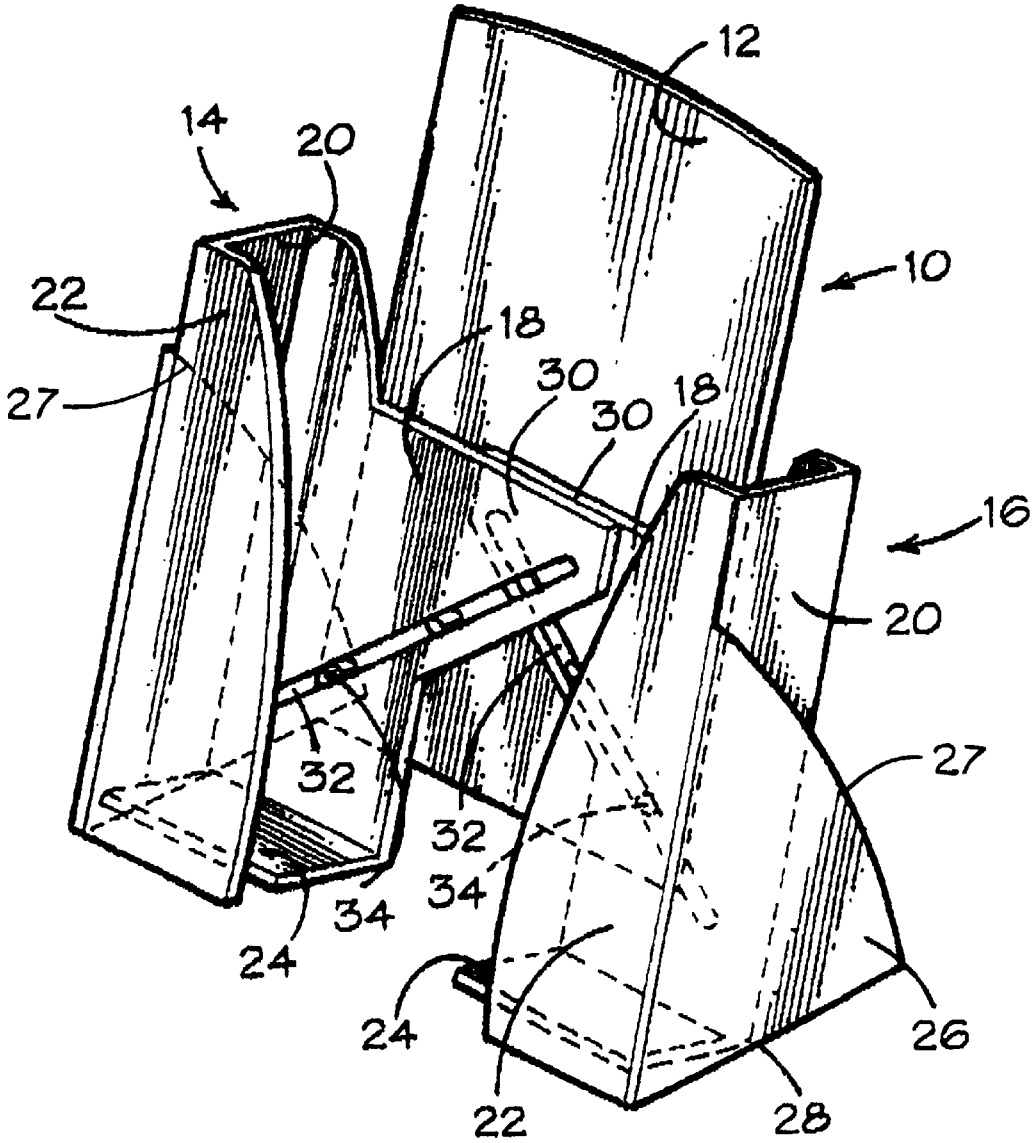
FIG. 1 is a schematic perspective view of the holder for sheet-form articles in accordance with the invention.

In the drawings the holder for sheet-form articles is indicated generally at 10. The holder comprises a rear support member 12 which is of generally rectangular shape.

Positioned in front of the rear support member 12 are a pair of side support members indicated generally at 14 and 16 respectively. Each of the side support members 14 and 16 comprises a rear plate 18, a side plate 20, a front plate 22, and a foot plate 24 which is located at the bottom of the rear plate 18 and extends forwards into contact with the rear face of the front plate 22. The rear plate 18, the side plate 20, the front plate 22 and the foot plate 24 together define a receiving space for sheet-form articles which are inserted into the holder. On the outside of each side plate 20 is provided a sector-shaped support plate 26 which by virtue of its shape acts as a rest for the holder and enables it to stand with the rear support plate 12 inclined backwards in order to display the articles within the holder attractively. The front edge of each support plate 26 is flush with the front edge of the associated side plate 20 and the bottom edge 28 of each support plate 26 is arranged to rest on the surface on which the holder is to stand. The rear surface 27 of each support plate 26 is shown as an arcuate surface but could alternatively be linear or of any other appropriate configuration.

Figure 2C:
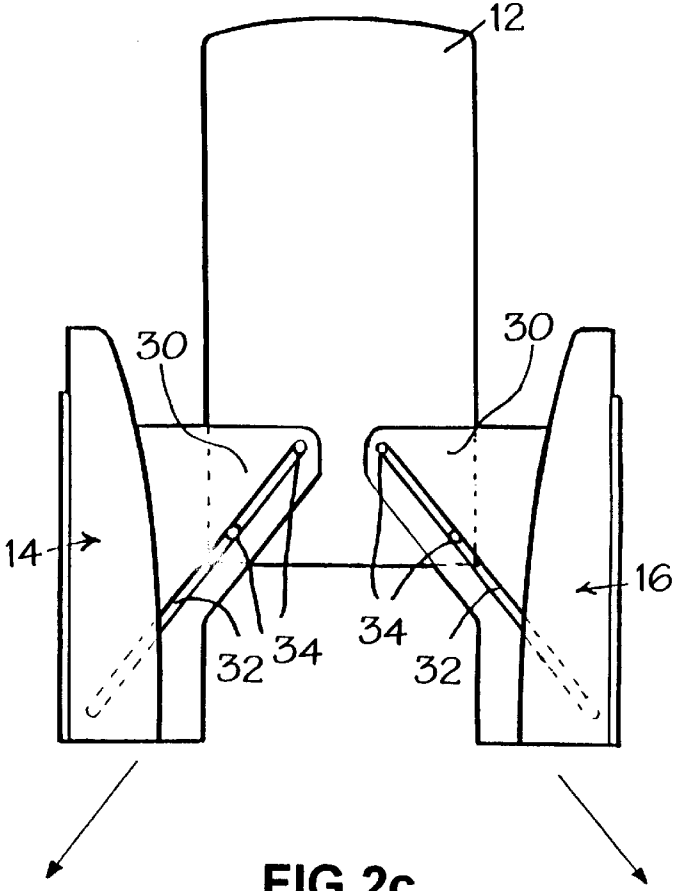
FIG. 2*c* is a schematic front view of the holder of FIG. 1, shown in the fully extended position; and, FIG. 3 is a partial view of one of the slots to illustrate how a stud can be located therein.

Each rear plate 18 of the two side support members 14 and 16 includes a wedge-shaped portion 30, as shown most clearly in FIGS. 1 and 2*c*, which projects towards the opposing side support member and which lies parallel to the rear support plate 12. As shown most clearly in FIG. 1, the two wedge-shaped portions 30 of the rear plates 18 lie one on top of the other and with the rearward one of the two in contact with the rear support member 12. Each rear plate 18 is provided with a generally diagonal slot or groove 32 therethrough with each slot running from adjacent to the bottom corner of the side support member 14, 16 up to a position adjacent to the outer end of the wedge-shaped part 30 of the rear plate 18. The rear support plate 12 is fitted with four fixed-position studs or pins 34 at the lower region of the plate which project forwards through the slots 32 in order to serve as guides for the side support members 14 and 16.

Figure 2B:
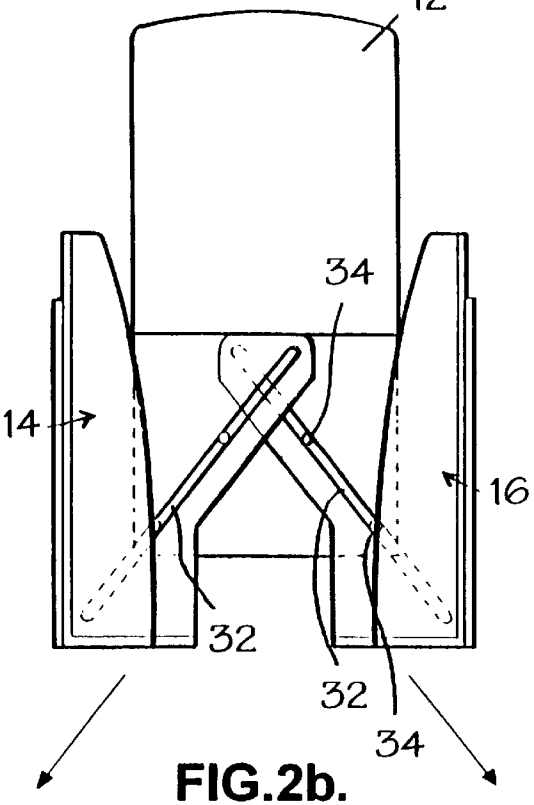
FIG. 2*b* is a schematic front view of the holder of FIG. 1 in the partially extended position as shown in FIG. 1.
Figure 2A:
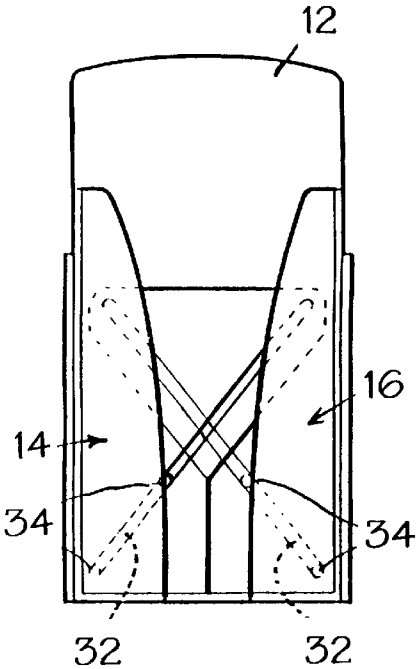
FIG. 2*a* is a schematic front view of the holder of FIG. 1, shown in the fully retracted position.
Figure 3:
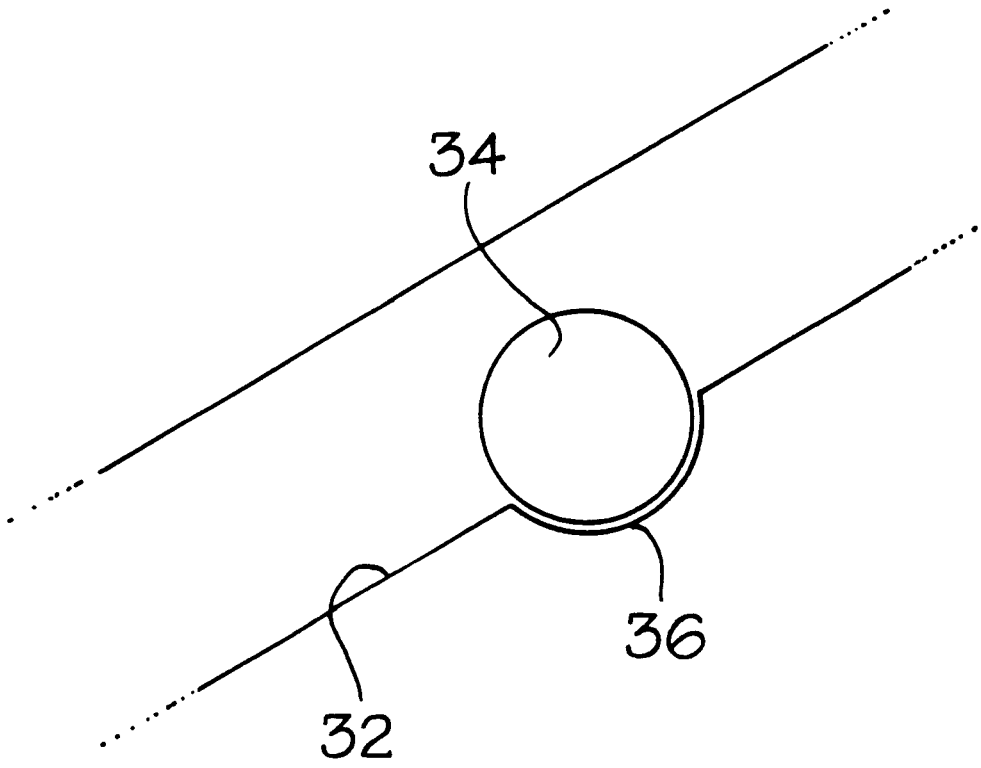

As shown most clearly in FIGS. 2*a* to 2*c*, the provision of the slots 32 and studs 34 enables the side support members 14 and 16 to be slidable jointly between a retracted position as shown in FIG. 2*a*, through a partially extended position as shown in FIG. 2*b*, to a fully extended position as shown in FIG. 2*c*, and vice versa. In the movement of the side support members from the retracted to the extended positions and vice versa the rear plates 18 slide over one another and over the rear support member 12, guided by the slots 32 and studs 34. The slots 32 are preferably provided with appropriate means to locate the studs 34 at particular predetermined positions along the length of the slots, to correspond for example to the three illustrated settings. As shown in FIG. 3, this can consist for example of providing small recesses 36 in the lower side of each slot 32, into which the studs 34 can locate and remain in position. Any suitable alternative location means can be used to provide predetermined settings.

The holder of the present invention can be adapted for use with sheet-form articles of any sizes. For example, in the position shown in FIG. 2*c*, the holder can receive A4 size leaflets, in the position shown in FIG. 2*b* it can receive AS size leaflets, and in the position shown in FIG. 2*a* it can receive leaflets of one third A4 size. Alternative settings could be provided as required.

It will be appreciated, especially from FIGS. 2*a* to 2*c*, that the sliding movement of the side support members 14, 16 away from each other to increase the width of the space for the articles simultaneously increases the relative height of the rear support member 12. This has the advantage that articles of relatively large width, which are often also large in their other dimensions, are still well supported by the rear support member 12.

The holder of the present invention can be made of any materials and by any methods. However, the holder is particularly adapted to be manufactured by molding techniques and can be made for example of a clear plastics material. However, the invention is not to be considered as being limited by the materials or dimensions of the holder.

While the present invention has been described with reference to a particular embodiment, those skilled in the art will recognize that many changes may be made thereto without departing from the spirit and scope of the present invention.

What is claimed is:

1. A holder for sheet-form articles which comprises a stand comprising:

i) a rear support comprising a longitudinal axis against which the articles are arranged to rest and a face having a plurality of studs extending therefrom;

ii) a pair of side support members for edgewise support of the articles and defining a receiving space for the articles therebetween, each of the side support members being shaped to define a generally u-shaped support to encompass a marginal portion of a stack of articles to be held in the receiving space, each of the generally u-shaped supports comprising a rearward limb comprising a diagonally extending slot that is slidable on at least one of the studs to slide the side support members relative to the rear support, the holder being movable between extended and retracted positions to vary the width of the receiving space, by moving the side support members in directions diagonally relative to the longitudinal axis of the rear support member by sliding each of the support member slots on at least one of the studs.

2. A holder as claimed in claim 1, in which the movement of the side support members relative to the rear support enables the holder to be adjusted to receive articles between a predetermined maximum width dimension and a predetermined minimum width dimension or any dimension in between.

3. A holder as claimed in claim 1, in which the side support members are locatable in at least three predetermined positions.

4. A holder for sheet-form articles which comprises a stand comprising:

i) a rear support member having a front face against which the articles are arranged to rest, and ii) first and second side support members for supporting respective sides of the articles, the first and second side support members being slidably engaged with the rear support member by pins disposed on the rear support that slide in grooves in the support members, and the side and rear support members together defining a receiving space therebetween in which the articles can be positioned, wherein the side support members are movable by a sliding motion relative to the rear support member whereby the pins move in the grooves to vary the width of said receiving space and to simultaneously vary the effective height of the rear support member and the front face of the rear support member such that when the width of the space is increased the effective height of the rear support member is increased.

5. A holder as claimed in claim 4, in which each of the side support members is shaped to define a generally u-shaped support comprising a rearward limb comprising a diagonal slot.

6. A holder for sheet-form articles which comprises a stand comprising:

i) a rear support against which the articles are arranged to rest comprising a plurality of studs;

ii) a pair of side support members for edgewise support of the articles and defining a receiving space for the articles therebetween, each of the side support members comprising a generally diagonal slot in which at least one of the plurality of rear support member studs rests, the pair of side support members each being movable, but not rotatable, relative to the rear support in directions extending generally diagonally relative to a longitudinal axis of the rear support, the holder being movable between extended and retracted positions to vary the width of the receiving space by sliding the slots of each of the side members relative to the stud disposed within the respective slot.

7. The holder of claim 6, wherein the plurality of studs comprise two pairs of studs that are each disposed generally in a diagonal line.

* * * * *